US009021653B2

(12) United States Patent
Zachay

(10) Patent No.: US 9,021,653 B2
(45) Date of Patent: May 5, 2015

(54) CLEANING DEVICE FOR A CONVECTION SECTION OF A THERMAL POWER PLANT

(75) Inventor: Richard Zachay, Voerde (DE)

(73) Assignee: Clyde Bergemann GmbH Maschinem-Und Apparatebau, Wesel (DE)

( * ) Notice: Subject to any disclaimer, the term of this patent is extended or adjusted under 35 U.S.C. 154(b) by 901 days.

(21) Appl. No.: 13/133,226

(22) PCT Filed: Dec. 1, 2009

(86) PCT No.: PCT/EP2009/066169

§ 371 (c)(1),
(2), (4) Date: Aug. 18, 2011

(87) PCT Pub. No.: WO2010/066610

PCT Pub. Date: Jun. 17, 2010

(65) Prior Publication Data

US 2011/0296837 A1 Dec. 8, 2011

(30) Foreign Application Priority Data

Dec. 9, 2008 (DE) ..... 10 2008 060 887

(51) Int. Cl.

| | |
|---|---|
| ***F23J 3/02*** | (2006.01) |
| ***F28G 1/16*** | (2006.01) |
| ***F28G 15/00*** | (2006.01) |

(52) U.S. Cl.

CPC . *F23J 3/023* (2013.01); *F28G 1/16* (2013.01); *F28G 1/166* (2013.01); *F28G 15/00* (2013.01)

(58) Field of Classification Search

CPC ..... F28G 1/166; F28G 1/16; F28G 1/00; F23J 3/00

USPC ..... 15/317, 318

See application file for complete search history.

(56) References Cited

U.S. PATENT DOCUMENTS

| | | | | |
|---|---|---|---|---|
| 1,851,559 | A * | 3/1932 | Arey | 15/317 |
| 2,052,912 | A * | 9/1936 | Weis | 15/317 |
| 2,257,936 | A * | 10/1941 | Bowers et al. | 15/317 |
| 3,439,376 | A * | 4/1969 | Nelson et al. | 15/317 |
| 5,181,482 | A | 1/1993 | Labbe et al. | |
| 5,237,718 | A * | 8/1993 | Brown | 15/318.1 |
| 5,416,946 | A * | 5/1995 | Brown et al. | 15/318 |

FOREIGN PATENT DOCUMENTS

| | | |
|---|---|---|
| DE | 10144304 A1 | 3/2003 |
| WO | 0151852 A1 | 7/2001 |

* cited by examiner

*Primary Examiner* — Bryan R Muller
(74) *Attorney, Agent, or Firm* — BainwoodHuang

(57) ABSTRACT

A cleaning device includes at least: a holder, a lance having a fluid distribution device, a drive unit for a translational motion of the lance in the holder, and a fluid conducting system having a feed, a return, and flow paths starting from the feed to the return and to the fluid distribution device. At least one actuating means (or actuator) is provided in order to connect the feed to the return or to the fluid distribution device as needed. Furthermore, a method involves cleaning heating surfaces of a convection section of a thermal power plant that includes spaced heat exchanger pipes using such a cleaning device.

6 Claims, 2 Drawing Sheets

CLEANING DEVICE FOR A CONVECTION SECTION OF A THERMAL POWER PLANT

Figure 1:
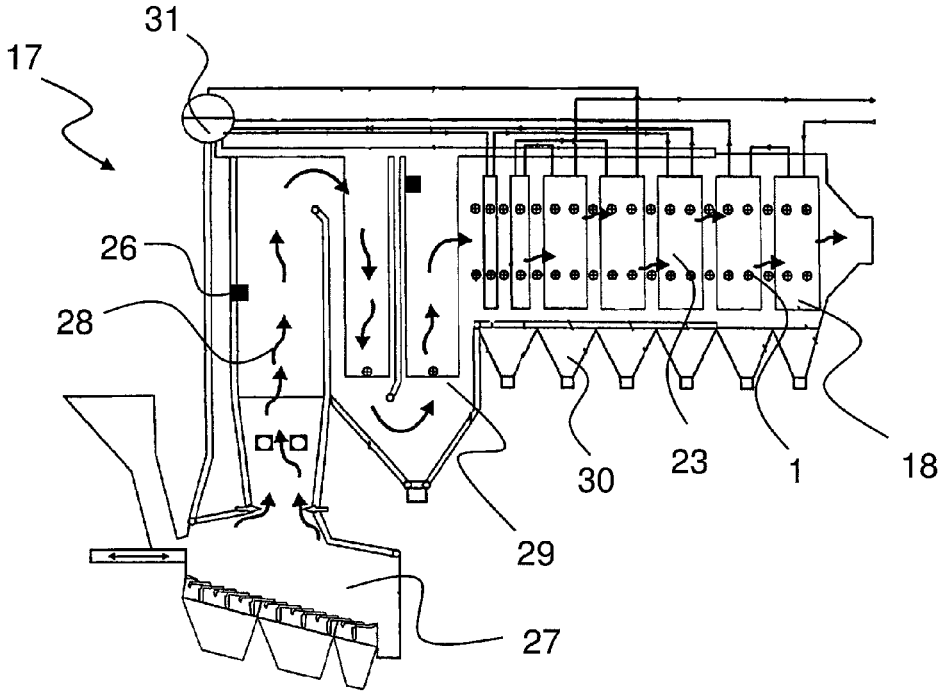

The invention refers to a cleaning device for cleaning heating surfaces inside a thermal power plant, especially in a so-called convection section of the thermal power plant. The invention is especially applicable in thermal power plants in the style of a waste combustion plant, a substitute fuel plant or a biomass combustion plant. Provision is routinely made there (especially in the so-called convection section) for a large number of heating surfaces which are brought into contact with the flue gas from the combustion in the furnace of the thermal power plant. Via these convective heating surfaces, the temperature of the flue gas is lowered and at the same time the energy which is yielded by the flue gas is transmitted in the form of heat to a cooling medium circuit. These heating surfaces are especially provided with spaced-apart heat exchanger tubes in the style of banks and/or in the style of a top surface for the wall of the thermal plant, especially as so-called superheaters, evaporators and/or economizers.

In such thermal power plants, the flue gas also brings along a succession of combustion residues which, as a result of contact with the convective heating surface, are deposited there in particular. Especially in the case of the aforesaid fuels and the existing temperatures in each case, solid and/or paste-like residues can be formed on the heating surfaces. These residues, which cover the heating surfaces, reduce the heat transfer from the flue gas to the cooling medium and therefore reduce the efficiency of such a thermal power plant. Moreover, it is also to be taken into consideration that these residues also reduce the cross section of the thermal power plant which is exposable to free flow, as a result of which an unwanted increase of the flow resistance and/or increased corrosion can take place.

For cleaning such heating surfaces, in addition to mechanical rappers it is known to also use so-called sootblowers, for example. Sootblowers are used for radiating a stream of a blowing medium (selected in dependence upon the place of application), such as steam, air and/or water, onto heat-exchanger surfaces of thermal power plants. These sootblowers are periodically operated during operation of the thermal power plant in order to clean the heating surfaces for restoring the desired operating characteristic. Such sootblowers customarily have a lance tube which is connected to a pressurized blowing-medium source. The sootblower also comprises at least one nozzle from which the blowing medium is discharged in the form of a stream or jet. In a retractable sootblower, the lance tube is periodically inserted into the interior of the thermal power plant and withdrawn from this, when, or while, the blowing medium is discharged from the nozzles. In a stationary sootblower, the lance tube occupies a stationary position in the thermal power plant and is periodically rotated while the blowing medium is discharged from the nozzles. In any case, the impingement effect of the discharged blowing medium upon the residues which have accumulated on the heating surface creates a temperature shock and also a mechanical shock, which is to loosen the residues. As an example of such a sootblower, reference is also made to WO-A-2001/051852 in this case.

Previously, cleaning in the convection section of the thermal power plant was customarily carried out with steam. This steam, in the case of thermal power plants which were operated with coal, for example, was extracted from the cooling circuit upstream of the turbine and made available to the sootblowers. The use of fuels of lower calorific value, such as waste or biomass, led to a lower or substandard steam production so that in this case the steam was no longer able to be delivered onto the heating surface with sufficient kinetic energy. Furthermore, steam is partially very moist, which could lead to increased corrosion. In addition, it was established that, especially in the case of these fuels, residues which are very difficult to remove are formed on the heating surfaces, which residues cake like cement during treatment with water-steam and consequently within a few weeks of operation of the thermal plant led to a mechanical cleaning having to be carried out in this case with the thermal power plant shut down.

Furthermore, experiments were undertaken to also carry out treatment of the residues with water in the region of the convection section of a thermal power plant. In this case, however, it is considered as being a problem that it cannot be guaranteed that the water is still in a liquid state in the case of the low feed speed over a blowing distance of, for example, more than 5 meters. Rather, the water was eventually in vaporous form before this was discharged onto the heating surfaces, which, with the temperatures of up to 1000° C. prevailing there and the low volume of about 0.4 l/sec., is understandable. Also, a way equally had to be found to counteract the anticipated risk of corrosion as a result of the fluid admission.

Starting from this, it is the object of the present invention to at least partially solve the problems which are described with reference to the prior art. To be disclosed in particular is a cleaning device which structurally is of simple construction and which can be operated with lower expenditure on control engineering. In this case, cleaning of a convection section of a thermal power plant is to be realized in a particularly careful and effective manner during operation of the thermal power plant.

These objects are achieved with a cleaning device and also with a method for cleaning heating surfaces of a convection section of a thermal power plant. Further advantageous embodiments of the invention are disclosed herein. Reference is made to the fact that the features which are individually explained herein can be combined with each other in any, technologically expedient way and disclose further embodiments of the invention. The description, especially in conjunction with the figures, explains the invention and specifies additional example embodiments.

The cleaning device according to the invention comprises at least:

- a holder,
- a lance with a fluid distribution device,
- a drive unit for a translational movement of the lance in the holder,
- a fluid conducting system with a feed, a return, and flow paths extending from the feed to the return and to the fluid distribution device, wherein provision is made for at least one actuating means for the requirement-based connection of the feed to the return or to the fluid distribution device.

The cleaning device is constructed especially in the style of a sootblower, a rotary long retractable sootblower, or the like. For this purpose, provision is made for a holder which can be constructed for example in the style of a frame or a support system with or without housing. A lance, with the fluid distribution device at a distance from the bottom, is now mounted or guided in this holder. The lance is essentially of a metal and tube-like construction, wherein the fluid which is used for cleaning is preferably fed at a rear end, flows through the lance and, depending upon requirement, is delivered via the fluid distribution device at the opposite end. The fluid distribution device can be constructed as an opening, as a nozzle or in another way. In principle, the lance can also have a plurality of openings or nozzles for delivery of the fluid. A drive unit for translational movement (linear movement, axial movement) of the lance in the holder is preferably also fastened on the holder. The drive unit, for example a motor, serves especially for displacing or for moving the lance as a whole, or a section of it, in relation to the holder. In principle, it is possible that a plurality of drives are provided for different movements or one drive is provided for a plurality of movements (axial and/or rotational). Consequently, the holder serves especially also as a guide and a support for the lance in the various movement phases.

Henceforth, this cleaning device is constructed with a fluid system which forms (a plurality of) flow paths inside the lance. A first flow path is now constructed in a way, for example, that the fluid coming from the feed flows into the lance, flows axially through this, and finally leaves again via the return with an opposite flow direction. A second flow path is constructed to the effect that the fluid reaches the lance via the feed, flows through the lance, and leaves the lance via the fluid distribution device. In particular, only these two different flow paths are realized in the lance. Henceforth, provision is made for actuating means which involve a requirement-based change of the formed flow paths inside the lance. The actuating means can thereby be constructed in the simplest case so that either only the first flow path or the second flow path is formed (binary positions: on-off), however in another actuating means provision can also be made for at least one intermediate position in which the fluid (partially in each case) therefore follows both the first flow path and the second flow path.

This embodiment of the cleaning device now makes it possible for the lance (in the active phase) to be continuously exposed to throughflow with (cold) water or with another suitable cleaning fluid during operation of the cleaning device. During insertion of the lance into the thermal power plant through the wall, the lance is subjected to the hot environmental conditions. The water which flows through the lance forms an internal cooling circuit for the lance and ensures that the water therein is still in a liquid state even in the case of an already longer movement path or a longer residence time of the lance. Therefore, the lance of the cleaning device can be inserted over more than 5 m or even 10 m, for example, into the inner regions of the thermal power plant before the fluid is finally delivered without the water in the lance evaporating. Not until the lance or the fluid distribution device is oriented exactly towards the desired heating surface can the actuating means be activated so that the fluid can be delivered via the fluid distribution device, especially immediately within a few seconds. At this point in time, the internal cooling circuit of the lance is consequently used as a reservoir for the admission of the cleaning fluid.

According to a embodiment of the cleaning device, the flow paths are formed with concentric tubes which are at least partially relatively movable to each other. In particular, the cleaning device is constructed so that both the feed system and the return system are formed in each case with two telescopically mutually displaceable and sealed tubes (inner tube/outer tube). Thus, it is very especially preferred that the lance on the outside forms an outer feed tube which ultimately constitutes the limit to the environment and in particular also forms the fluid distribution device. This outer feed tube is mounted in a fluidtight manner on, or in, an inner feed tube. The drive unit now causes the outer tube to be translationally or axially displaced on, or in, the inner feed tube so that the path length of the inflowing fluid via the feed flows along the inner generated surface first of the inner feed tube and then also of the outer feed tube. In this way, the fluid can flow from the feed right up to the oppositely disposed fluid distribution device. This first flow path is inwardly delimited by two telescopically mutually displacable and sealed return tubes. An outer return tube is fastened for example to the outer feed tube close to the fluid distribution device so that this outer feed tube is also moved during the axial movement. The outer return tube in this case is also positioned on the inner return tube in a fluidtight manner on the outside or inside. The drive unit now particularly causes the outer return tube to be similarly telescopically displaced on, or in, the inner return tube along with the displacement of the outer feed tube onto, or into, the inner feed tube. With this tube system, the forming of the different flow paths can consequently be realized in a constructionally very simple manner.

Furthermore, it is considered as being advantageous that the at least one actuating means comprises a shut-off means for the return. The cleaning device with the holder is customarily attached on the outside adjacent to the wall of the thermal power plant. At a rear end, the return emerges from the cleaning system and is therefore arranged far away, and easily reachable, from the thermal power plant. Here, actuating means, with which the different flow paths inside the lance can be formed to suit requirement, can now therefore be positioned for a manual operation and/or for an automatic operation. As shut-off means, especially valves and/or slides come into consideration in this case. With these shut-off means, it is possible to reduce or to widen the cross section of the return so that the returning amount of fluid can be controlled. If the return is (partially) closed, the pressure inside the lance rises. This effect can be used to activate the fluid distribution device. In any case, the first flow path from the feed to the return is also (partially) interrupted, however, so that if necessary a forced guiding of the fluid to the fluid distribution device takes place.

According to a further embodiment of the cleaning system, the fluid system forms a pressure-sensitive switch in the lance. This particularly means in other words that provision is made for components integrated into the lance which as a result of different pressure states inside the lance or in the fluid conducting system independently realize flow diversions to specifically predetermined flow paths. The pressure-sensitive switch is particularly constructed so that in the case of a low pressure level this realizes a first flow path in the lance, in which the fluid flows from the feed to the return. In the case of a higher pressure level, the pressure-sensitive switch "switches over" the fluid conducting system so that the fluid (at least partially) now flows from the feed to the fluid distribution device. If this increased pressure level is maintained, then a delivery of fluid via the fluid distribution device is carried out (timewise just as long), whereas the flow path from the feed to the return is independently realized again if the pressure level falls below a predetermined level.

It is very especially preferred if a valve or a restrictor is provided as a pressure-sensitive switch. In the case of a valve, spring-mounted check valves or overpressure valves especially come into consideration. These shut off the second flow path, for example, until the pressure of the fluid in the lance is sufficiently high and as a result, the spring-preloaded valve is opened. Technically simpler, and with regard to the high temperatures possibly also more insensitive to malfunction, is the use of a restrictor (a tube constriction, for example) as a pressure-sensitive switch. The restrictor is especially constructed as a flow cross section constriction for the fluid. It is only exposed to throughflow if a certain pressure level exists inside the lance. Furthermore, the restrictor can be arranged in a turbulent region (section of the lance exposed to less throughflow) of the fluid with regard to the first flow path, in which the fluid flows from the feed to the return. Consequently, the restrictor is therefore acted upon by fluid to its full extent only in the case of the desired connection of the feed to the fluid distribution device. For this purpose, the restrictor can be arranged for example in the diversion region or close to the distribution device.

It is particularly advantageous if the cleaning device has a path correction device. In the case of this path correction device it is especially a positioning device with which the cleaning device is especially vertically pivotable for at least partial compensation of sagging of an overhanging section of the cleaning device, especially an overhanging section of a cleaning device inside a thermal power plant. In other words, this means that by means of the path correction device the cleaning device is especially vertically pivotable relative to a (fictitious) horizontal plane so that sagging of an overhanging section of the cleaning device relative to this (fictitious) horizontal plane is reduced. It is clear to see that the pivoting can also be a rotation of the cleaning device, especially around a rotational point which is located especially in the region of an opening in a wall of a thermal power plant. As a result of this, especially the lowering of a fluid distribution device of the cleaning device as a result of a gravity force-induced sagging of an overhanging section of the cleaning device can be advantageously at least partially compensated, as a result of which cleaning of horizontal regions, especially of thermal power plants, can be carried out essentially regardless of the length of an overhanging section of the cleaning device. The path correction device is preferably arranged in a region lying opposite the fluid distribution device, especially at an end of the cleaning device lying opposite the fluid distribution device. For this, a rear suspension of the cleaning device especially comes into consideration. In this case, a construction of the path correction device as a spindle drive is preferred, wherein the path correction device is connected (especially in a data-transmitting manner) to a control unit and can especially be operated by this in a specific manner. Especially preferred is the use of a path correction device in conjunction with a connection of the feed and/or of the drain of the cleaning device to a fluid supply system by one or more (flexible) hose connections.

With regard to the preceding concept, it is especially proposed that a path correction device is integrated mechanically and control engineering-wise in the region of the rear (outer) suspension of the lance. When putting the cleaning device into operation, depending upon the travel distance of the lance into the thermal power plant and/or upon the temperature, the fluid distribution device—with reference to a preknown path curve (variation or lowering of the fluid distribution device as a result of the overhanging length of the lance)—is positioned in the desired vertical position by means of the actuating drive, processed control engineering-wise, and stored. During operation, the path correction device can then be activated (if necessary only at defined points in time and/or with defined situations of the path curve), wherein the rear region of the lance is lowered. Therefore, the effect is achieved of the (especially radially water distributing) fluid distribution device being able to deliver fluids deep into the (narrow) gaps between the heat exchanger tubes so that impingement upon the heat exchanger tubes themselves can be reduced or even avoided. This concept, if necessary, can also be used independently of the basic construction of the lance, but is very advantageous especially in the case of cleaning device with a flexible feed (in the style of a hose, for example).

Moreover, it is considered as being advantageous that a multiplicity of cleaning devices which are described here according to the invention are provided in a thermal power plant with a convection section, wherein a fluid supply system and a control unit are provided for the sequential operation of the cleaning devices. In the case of the thermal power plant, it is preferably one of the following thermal plants in this case: waste combustion plant, substitute fuel combustion plant, biomass combustion plant. In particular, a single fluid supply system is provided for all the provided cleaning devices. A control unit which is provided for the operation of all the cleaning devices realizes the sequential operation of the cleaning device during operation of the thermal power plant in a way that only one cleaning device in each case is actively inserted into the convection section and carries out cleaning there in a purposeful manner. The control unit especially also serves for acting upon the actuating means for the requirement-based connection of the feed to the return or to the fluid distribution device in each cleaning device. For this purpose, the control unit can especially also resort to sensor-detected measured values and information about contamination of the heating surfaces, etc.

Moreover, it is considered as being advantageous that the convection section of the thermal power plant has spaced-apart heat exchanger tubes and the cleaning devices can be translationally introduced through a wall of the thermal power plant into the convection section so that the fluid distribution device of the lance reaches the spaced-apart heat exchanger tubes. This especially means that the section of the lance which forms the fluid distribution device is positioned in direct proximity of the heat exchanger tubes which are to be cleaned. If no cleaning is to take place, the lance is located outside the thermal power plant. For cleaning, the lance is now inserted through a corresponding opening in the wall of the thermal power plant and inserted over a travel distance of up to 5 m or even up to 10 m, for example, into the inner regions of the thermal power plant. Thus, the fluid distribution device of the lance can be positioned inside the thermal power plant beneath or next to, for example, the heat exchanger tubes which are to be cleaned.

According to a further aspect of the invention, a method is also proposed for cleaning heating surfaces—having spaced-apart heat exchanger tubes—of a convection section of a thermal power plant with a cleaning device according to the invention here, wherein an intermittent delivery of a fluid between the spaced-apart heat exchanger tubes is carried out. This means in other words that the cleaning device, in which the cleaning fluid routinely discharges in a jet-like manner radially to the lance, is inserted into inner regions of the thermal power plant or of the convection section so that the fluid jet is delivered (substantially) only between the spaced-apart heat exchanger tubes. A direct blasting of the heat exchanger tubes with the supply pressure of the fluid is especially to be avoided. The actuating means or shut-off means can now be used for setting the pressure or the reach of the delivered fluid jet for the cleaning of the heating surfaces. Thus, pressures of 2 bar up to for example 10 bar can especially be set in a specific manner. Whereas the lance is no longer moved axially in this case, a (limited) rotation can additionally be carried out so that for example blowing angles in the region of 60°, for example, are realized, possibly with different fluid pressures.

Also considered as being advantageous is a method in which the fluid coming from a feed flows in the style of a sheath flow in the lance right up to a surrounding region of the fluid distribution device and, depending upon requirement, flows periodically a) inside the sheath flow back to the return or b) into the fluid distribution device. With this realization of the fluid conducting system inside the lance the effect is achieved of the cold fluid, coming from the feed, contacting and therefore cooling the outer tubes of the lance. This cylindrical flow in the style of a sheath is preferably maintained over the entire length of the lance right up to a surrounding region of the fluid distribution device during all operating phases of the cleaning device. If cleaning is not to be carried out, the fluid now flows inside the sheath flow back again to the return (variant a)). In the case of cleaning, a direction reversal of the fluid, via the actuating means and a pressure-sensitive switch, for example, can be achieved so that the fluid does not flow back inside the sheath flow to the return but into the fluid distribution device and therefore out of the lance (step b)).

Furthermore, it is also advantageous if sagging of an overhanging section of the cleaning device is compensated. This especially means that compensation of sagging of the overhanging section of the cleaning device is carried out in dependence upon the length of the overhanging section of the cleaning device, especially by (vertical) pivoting of the cleaning device. In particular, by compensating for sagging of the overhanging section of the cleaning device, guiding of a fluid distribution device of the cleaning device in a (largely) horizontal plane is advantageously possible substantially regardless of the length of the overhanging section of the cleaning device. Reference is additionally made here to the above embodiments for the path correction device.

Figure 2:
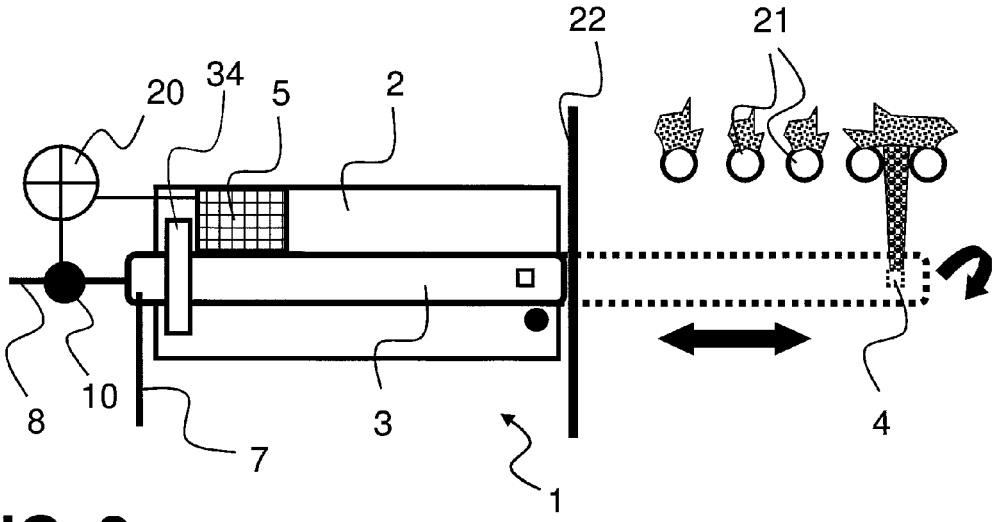
Figure 3:
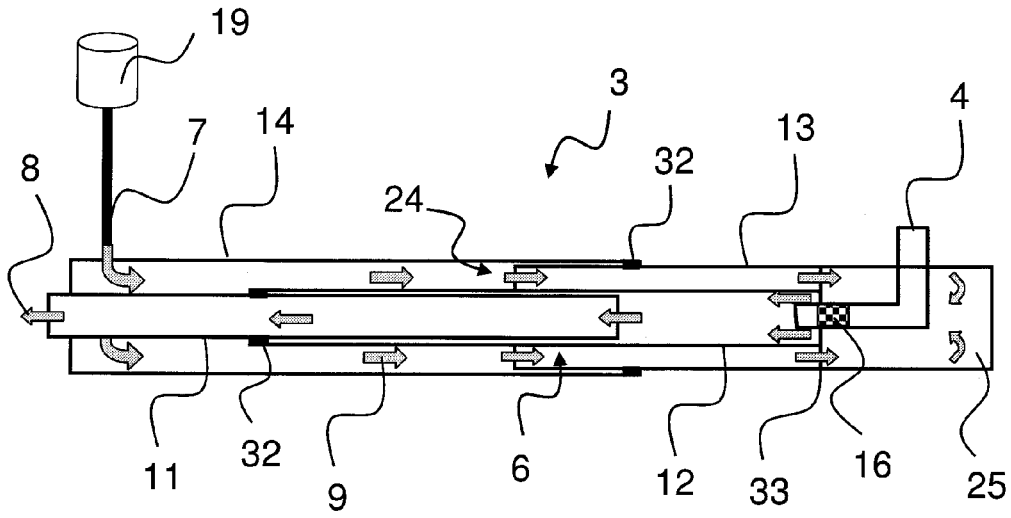
Figure 4:
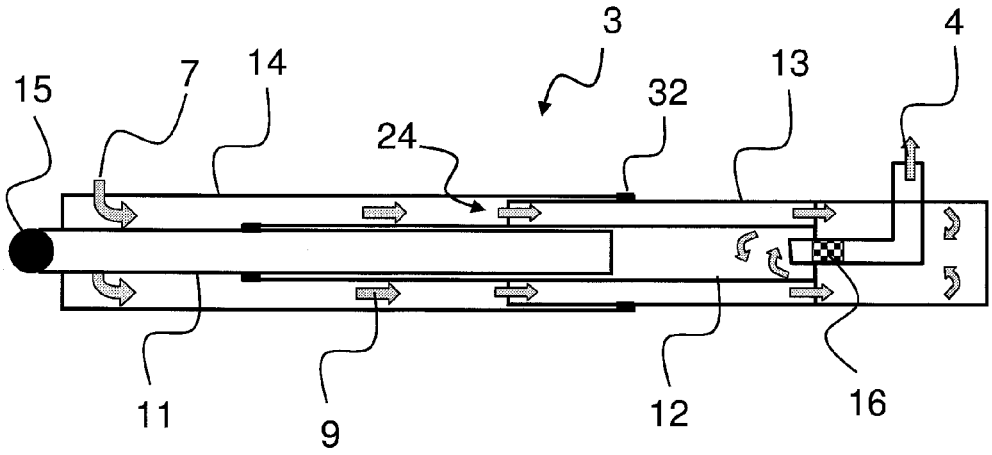

The invention and also the technical field are subsequently explained in more detail with reference to the figures. Reference is made to the fact that the figures show especially preferred embodiment variants of the invention, but the invention is not limited to these. Schematically in the figures is shown:

FIG. 1: a construction of a thermal power plant,

FIG. 2: a construction of a cleaning device,

FIG. 3: a further embodiment variant of a cleaning device in a first operating phase, and FIG. 4: the cleaning device from FIG. 3 in a second operating phase.

FIG. 1 shows a thermal power plant 17 for waste combustion or biomass combustion, for example. Shown at the bottom to the left in this case is the furnace 27 in which the waste or the biomass is combusted. The flue gas which results in the process flows in the flow direction 28 first through a series of blank passes 29. In this case, provision may also be made on the walls of the furnace 27 or of the blank passes 29 for banks of spaced-apart heat exchanger tubes so that a first exchange of heat is realized here. Moreover, provision may also be made here for sensors 26, with the aid of which slagging and/or state parameters of the flue gas can be detected.

After passing through the blank passes 29, the flue gas reaches the so-called convection section 18. Arranged here are a large number of heating surfaces 23, disposed in a bank-like manner, which project into or hang in the flow cross section and are exposed to circumflow and/or throughflow by the flue gas. These heating surfaces 23 are connected to a cooling medium circuit 31 so that the cooling medium which flows through the heating surfaces 23 is heated as a result of the contact of the flue gas. The steam which is produced in the process serves for power generation, for example by this being passed through a corresponding turbine.

For cleaning these heating surfaces 23, provision is made here for a large number of cleaning devices 1, in the style of so-called sootblowers, for example, with which the slag or residues on the heating surfaces 23 are removed so that these fall into a funnel 30, for example, arranged beneath them, where they can be removed if necessary.

Especially for this cleaning of the heating surfaces 23 in the region of the convection section 18 of the thermal power plant 17, provision can be made for a cleaning device 1, as is shown in FIG. 2. The cleaning device 1 in this case comprises a holder 2, for example in the style of a frame which is formed with steel beams or the like and, if necessary, with a housing. This holder 2 serves for the fixing or supporting of the lance 3 and of a drive unit 5, in this case in the style of a motor. By the drive unit 5, the lance 3 is moved axially or translationally in relation to the holder 2 so that the lance 3 is moved through the wall 22 of the thermal power plant into the inner region. This is also shown here on the right in FIG. 2. In addition to this translational movement, the lance, if necessary, can also execute a rotary pivoting movement as well so that the fluid which is delivered via the fluid distribution device 4 can be introduced between spaced-apart heat exchanger tubes 21, for example, and free the gaps of residues or slag. Moreover, the cleaning device 1 has a path correction device 34, with which the cleaning device 1 can be vertically pivoted. The path correction device 34 is preferably constructed as a spindle drive which moves the end of the lance 3—which is located close to the feed 7 (especially in the case of a flexible feed)—downwards if the fluid distribution device 4 is inserted further into the interior of the thermal power plant 17 so that a) the fluid distribution device 4 remains essentially on the same horizontal and/or b) the delivered fluid jet extends substantially (only) vertically.

The rear section of the cleaning device which lies opposite the fluid distribution device 4 is formed by a fixed feed 7 and return 8 for the fluid, for example. For this purpose, especially pipes and/or hoses come into consideration. The feed 7 is connected to a fluid supply system, for example, so that in this case the fluid (especially water) can flow into the lance 3 as required, for example as soon as the lance 3 is to be moved into the thermal plant. Also on the rear end, provision is then made in, or on, the return 8 for an actuating means 10 which can be operated in a specific manner via a control unit 20, for example. The control unit 20, which in addition to operating the actuating means 10 is also responsible for the operation of the drive unit 5 in this case, can be formed separately for each cleaning device 1, but it is also possible that the control unit 20 operates a plurality of cleaning devices 1 and/or actuating means 10.

FIGS. 3 and 4 now show in a simplified arrangement a particularly simple construction of such a cleaning device (in this case basically only the section of the lance 3), in which a fluid conducting system 6 is formed with a feed 7 and a return 8, wherein two different flow paths 9 can be realized to suit requirement by means of a shut-off means 15 on the return 8.

In FIG. 3, the partially telescopically moved lance 3 is shown, wherein the fluid from the fluid supply system 19 flows in via the feed 7 and finally leaves the lance 3 again via the return 8. The operating phase in which the fluid is used (only) for cooling of the lance 3 is realized in this way. The fluid flows in this case via the feed 7 into a cylindrical annular chamber which is delimited between the outer feed tube 14 and the inner feed tube 13 on the one hand, and between the outer return tube 12 and the inner return tube 11 on the other hand. In this case, a type of sheath flow 24 is formed with the fluid so that the outer surroundings of the lance 3 are contacted by the cool fluid flow. Between the outer feed tube 14 and the inner feed tube 13, provision is made for a seal 32 (multiple packing, for example) which reliably avoids escape of the fluid. Such a seal 32 is also provided between the inner return tube 11 and the outer return tube 12.

On an end-face section of the outer return tube 12, lying opposite the return 8, provision is made for a guide 33, with which the outer return tube 12 is positioned concentrically to the inner feed tube 13. The guide 33, moreover, can be constructed so that the outer return tube 12 is fixed on the inner feed tube 13, that is to say is moved simultaneously with this. The guide 33 can be constructed in the style of a perforated annular disk. In the region of the lance tip and especially in the surrounding region 25 of the fluid distribution device 4, a flow deflection is carried out in a way that the sheath flow 24 collapses and an internal return is carried out. The fluid, to some extent already in the direction of the return 8, then flows into the return tubes and is directed to the return 8. Projecting into the outer return tube 12, for example, is an oppositely disposed connecting tube for the fluid distribution device 4, in which a pressure-sensitive switch 16 is now arranged. On account of the flow guiding which is shown here, this pressure-sensitive switch 16 is located in the turbulent region of the flow and therefore with this throughflow exposure or position of the actuating means does not come into contact with a high pressure of the fluid.

This situation now looks different if the return 8 is fully closed off by means of a corresponding shut-off means 15. The water columns which build up in front of the shut-off means 15 now lead to the fluid which enters the outer return tube 12 being deflected again and now acting upon the pressure-sensitive switch 16. The pressure-sensitive switch 16, which is constructed as a valve or restrictor, for example, yields at a predetermined pressure level so that the fluid can now flow through the pressure-sensitive switch 16 to the fluid distribution device 4 and consequently leaves the lance 3 in this way. Equally, the cooling function is also maintained for this cleaning process because at this point in time the fluid which enters via the feed 7 in the style of a sheath flow 24 also cools the lance 3.

The described variants of a cleaning device for cleaning convective heating surfaces are especially suitable for thermal power plants which are operated with waste or biomass, wherein a very simple and effective construction of the cleaning devices is realized. With the water cleaning of such heating surfaces which is achieved here, the availability period of such thermal plants can be significantly extended. Furthermore, controlling the admission pressure for the fluid allows an admission adapted to the type of residues or slag so that in addition to a simple wetting an abrasive (high-pressure) treatment and/or a simple quenching of the combustion residues can also be achieved.

LIST OF DESIGNATIONS

1 Cleaning device
2 Holder
3 Lance
4 Fluid distribution device
5 Drive unit
6 Fluid conducting system
7 Feed
8 Return
9 Flow path
10 Actuating means
11 Inner return tube
12 Outer return tube
13 Inner feed tube
14 Outer feed tube
15 Shut-off means
16 Pressure-sensitive switch
17 Thermal power plant
18 Convection section
19 Fluid supply system
20 Control unit
21 Spaced-apart heat exchanger tubes
22 Wall
23 Heating surface
24 Sheath flow
25 Surrounding region
26 Sensor
27 Furnace
28 Flow direction
29 Blank pass
30 Funnel
31 Cooling medium circuit
32 Seal
33 Guide
34 Path correction device

The invention claimed is:

1. Cleaning device, comprising at least:
a holder,
a lance with a fluid distribution device,
a fluid conducting system including a feed, a return, a first flow path in the lance extending from the feed to the return, and a second flow path in the lance extending from the feed to the fluid distribution device,
at least one valve in the return, and
a pressure-sensitive switch in the second flow path to the fluid distribution device,
wherein the pressure-sensitive switch is arranged inside the lance and (i) blocks the second flow path when the at least one valve is open and (ii) opens the second flow path when the at least one valve is closed responsive to a pressure level in the second flow path upstream of the pressure-sensitive switch.

2. Cleaning device according to claim 1, in which the flow paths are formed with concentric tubes which are at least partially movable relative to each other.

3. Cleaning device according to claim 1, in which the pressure-sensitive switch is a valve or a restrictor.

4. Cleaning device according to claim 1, having a path correction device.

5. Cleaning device according to claim 1, in which the at least one valve is arranged outside the lance.

6. Cleaning device according to claim 1, in which the pressure-sensitive switch is a spring-mounted check valve or an overpressure valve.

* * * * *